United States Patent [19]

Brunner et al.

[11] Patent Number: 4,754,286

[45] Date of Patent: Jun. 28, 1988

[54] LINE-FED PHASE CONTROLLED ANTENNA

[75] Inventors: Anton Brunner, Starnberg; Wolfgang Köethmann, Traubing, both of Fed. Rep. of Germany

[73] Assignee: Siemens Aktiengesellschaft, Berlin and Munich, Fed. Rep. of Germany

[21] Appl. No.: 785,227

[22] Filed: Oct. 7, 1985

[30] Foreign Application Priority Data

Oct. 18, 1984 [DE] Fed. Rep. of Germany ..... 3438261

[51] Int. Cl.[4] ..... H01Q 13/10

[52] U.S. Cl. ..... 343/771; 343/770

[58] Field of Search ..... 343/771, 767, 770, 789

[56] References Cited

U.S. PATENT DOCUMENTS 3,701,158 10/1972 Johnson ..... 343/770

3,711,858 1/1973 Reeder ..... 343/771

OTHER PUBLICATIONS

Öttl et al., "Monopuls Antenne der Boden-Station Für Satellitenfunk der Deutschen Versuchsanstalt", ntz, vol. 10, 1968, pp. 631-634.

*Primary Examiner*—William L. Sikes

*Assistant Examiner*—Robert E. Wise

*Attorney, Agent, or Firm*—Hill, Van Santen, Steadman & Simpson

[57] ABSTRACT

In order to achieve an improved monopulse difference pattern, a transition zone is created between the antiphase-excited halves of a phase-controlled antenna composed of a plurality of individual radiators, being created therein along a line of symmetry which separates the halves of the antenna and which comprises individual radiator strips, for example vertical columns or horizontal rows, extending next to one another and parallel to the line of symmetry, in which transition zone, extending from each edge up to the line of symmetry and the center of the transition zone, the number of individual radiators respectively excited antiphase increases in the same manner in comparison to the number of all individual radiators lying in a strip from 0% at each edge up to 50% at the line of symmetry. This principle also particularly applies to a monopulse antenna which is to generate a differential path both for the azimuth and for the elevation and which is composed of four quadrants which are respectively excited antiphase in pairs.

7 Claims, 5 Drawing Sheets

LINE-FED PHASE CONTROLLED ANTENNA

BACKGROUND OF THE INVENTION

1. Field of the Invention

The present invention relates to a line-fed phase-controlled antenna comprising a plurality of individual radiators disposed in a symmetrical surface for generating a sum pattern and a difference pattern which is generated by anti-phase amplitude excitation of the individual radiators at both sides of the line of symmetry, whereby a transition zone is also provided along the line of symmetry between the antiphase amplitude excitations.

2. Description of the Prior Art

As with standard radar antennae which are equipped with a primary radiator system and a parabolic reflector, electronically phase-controlled antennae can be operated in a so-called mono-pulse method for increasing the accuracy of target locating and of tracking wherein a sum pattern and, usually, two difference patterns for the azimuth plane and the elevation plane are employed. In order to enable a flat structure and in order to optimize the amplitude illumination and, therefore, the side lobe attenuation in the sum diagram, line feed is frequently employed in phase-controlled antennas, whereby each of the individual radiators is driven via a line belonging to a distributor network. Therewith, however, the optimum amplitude illumination over the antenna surface for the sum pattern is also effective with respect to magnitude for the azimuthal and elevation difference patterns, for which it is no longer optimum, but generates relatively high side lobes which only decrease slowly extending from the axial antenna direction.

A far-reaching optimization of the sum and difference amplitude illumination can be achieved in the case of utilization of the radiation feed principle by way of special measures at the quadruple primary radiator. What is disadvantageous, due to the radiation feed, is the great structural depth of the phase-controlled antenna arrangement and the limited accuracy for achieving a rated illumination as required, for example, for a maximum side lobe level of −40 dB.

The article by H. Oettl and L. Thomanek entitled "Monopuls-Antenne der Bodenstation für Satellitenfunk der Deutschen Versuchsanstalt fur Luft-und Raumfahrt e.V." in the periodical "NTZ", 1968, No. 10, pp. 631–634 discloses a line-fed phase-controlled antenna comprising a plurality of individual radiators disposed in a symmetrical surface for generating a sum pattern and two difference patterns which are generated by antiphase amplitude excitation of the individual radiators at both sides of two lines of symmetry. The two lines of symmetry divide the antenna surface into four quadrants. A meshing of the antiphase amplitude excitation is also provided along these lines of symmetry when generating the difference patterns. The meshing derives in that two lines of symmetry are equipped with individual radiators between the quadrants and belong to the neighboring quadrants in alternating sequence. This phase meshing for the formation of the difference pattern contributes to an improvement of the side lobe behavior and to the suppression of diagram shoulders in the difference pattern. However, optimized sum pattern, azimuthal difference pattern and elevation difference pattern cannot be formed with this phase meshing applied in a monopulse antenna, particularly in phase-controlled antenna arrangements comprising many individual radiators.

An application of three separate distributor systems for optimized sum channel, difference azimuth channel and difference elevation channel require three inputs per individual radiator having great impedance, cross-connection and loss problems.

SUMMARY OF THE INVENTION

Without such a three-fold distributor system and, therefore, without the expense connected therewith and the difficulties deriving from the additional expense, the object of the present invention, given a line-fed phase-controlled antenna equipped with a multitude of individual radiators, is to provide a difference excitation (illumination) which is largely matched to the optimum form (Bayliss) and comprises a high side lobe attenuation. The sum excitation (illumination) should thereby retain its original, optimum form.

According to the invention, the above object is achieved, in a line-fed phase-controlled antenna of the type initially set forth, the object being achieved in that, proceeding from each of the two edges of the transition zone up to the line of symmetry, the number of individual radiators in a strip respectively excited antiphase relative to the number of all individual radiators in the strip increases in the same manner from 0% at each edge up to 50% at the line of symmetry in the transition zone of identical width fashioned at both sides of the line of symmetry and composed of individual strips, for example vertical columns or horizontal rows, extending next to one another parallel to the line of symmetry. A steady amplitude transition between the two antenna halves can be achieved by an appropriate fashioning of the transition zone, so that the optimum difference excitation can be at least approximately achieved upon retention of the optimum sum excitation.

Advantageously, the anti-phase-excited individual radiators in the strips extending next to one another parallel to the line of symmetry are statistically distributed.

The transition zone can also be fashioned such that regions in which the individual radiators are excited antiphase are provided along the line of symmetry, being provided periodically and alternately on the one side and then, again, on the other side of the line of symmetry.

In this case, the antiphase individual radiator regions advantageously have at least the approximate form of equilateral triangles whose base lines coincide with the line of symmetry of the antenna surface. The surface share of the oppositely-disposed, antiphase halves increases in a wedge shape in this case and, therefore, steadily. The amplitude of the difference pattern in this case slowly retreats from the line of symmetry and crosses the 0 value with a finite slope at the line of symmetry.

The increase in the relative number of individual radiators respectively excited anti-phase in a strip extending parallel to the line of symmetry from 0% at the edges to 50% at the line of symmetry extending in the center of the transition zone can be linear, but can also be non-linear.

A vertically extending line of symmetry and a horizontally extending line of symmetry which divide the antenna surface into four quadrants are provided for generating a first difference pattern in the azimuth and a second difference pattern in the elevation. Not belonging to these quadrants, however, are those individual radiators which are excited antiphase in the transition zones along the respective symmetry line sections, in contrast whereto those individual radiators which lie equiphase along the respective symmetry line sections in the transition zones at the other side of these line sections do not belong to these quadrants. For the formation of the difference pattern with respect to azimuth, the two quadrants lying essentially to the left of the vertical line of symmetry are occupied antiphase relative to the two other quadrants, in contrast whereto for the formation of the difference pattern with respect to elevation, the two quadrants lying essentially above the horizontal line of symmetry are excited antiphase relative to the other two quadrants. In order to generate the sum pattern, all individual radiators of the antenna surface are excited equiphase or, respectively, with a linear phase progression given beam excursion.

Small orientation errors of the azimuth and/or of the elevation axis of the phase-controlled antenna which may possibly occur can be corrected by a slight axial rotation of the antenna. The antiphase, periodic individual radiator regions along the lines of symmetry can also be designed and/or distributed such that no orientation errors of the azimuth axis and/or of the elevation axis occur.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
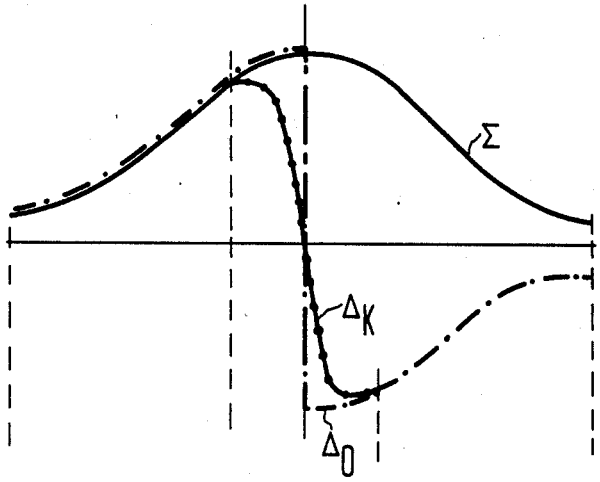
FIG. 1 is a graphic illustration of a sum excitation pattern and two different difference excitation patterns.

Referring to FIG. 1, amplitude illuminations $\Sigma$, $\Delta_0$ and $\Delta_K$ are illustrated for generating an optimum sum pattern and two different difference patterns in one plane. Given line-fed phase-controlled antennae, each of the individual radiators has a specific, relative amplitude which is defined for the sum and for the difference case. In the difference case, a phase shift of 180° is induced at the line of symmetry of the antenna surface, whereby a sharp minimum is, in fact, generated in the direction of maximum radiation but, at the same time, a very slowly decreasing, outer pattern edge having high side lobes is generated. This difference illumination $\Delta_0$ is shown with a dot dash line in FIG. 1. The difference excitation can be largely matched to the optimum form (Bayliss) by a steady transition between the two antisymmetrical halves and the side lobe attenuation can thereby be increased. This favorable difference illumination is referenced $\Delta_K$ in FIG. 1.

The sum illumination $\Sigma$, however, must retain its original, optimum form.

Figure 2:
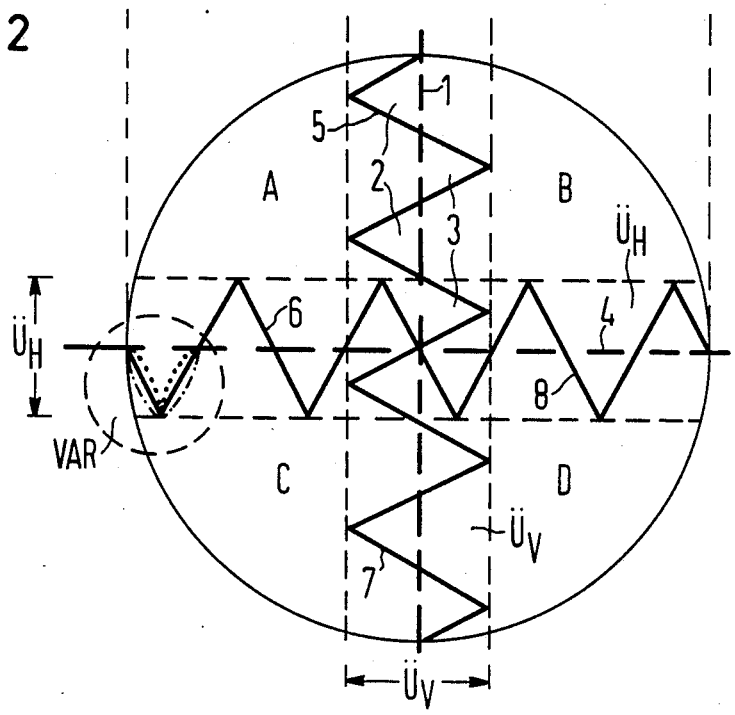
FIG. 2 is a schematic representation of a quadrant distribution with a phase-controlled antenna constructed in accordance with the invention for generating difference patterns which are low in side lobes.

The illuminations $\Sigma$ and $\Delta_K$ of FIG. 1 holds true for a phase-controlled antenna constructed and operated in accordance with the invention and illustrated in FIG. 2 for a phase-controlled monopulse antenna which is to generate a difference pattern both in the azimuth plane and in the elevation plane. The difference illumination must be improved both in the azimuth level and in the elevation level, i.e. a steady transition between the antiphase halves must be created both over a vertical symmetry level 1 as well as over a horizontal symmetry level 4 of the antenna. This steady amplitude transition between the respective antenna halves, i.e. between the 4 quadrants of a phase-controlled antenna area, can be generated in accordance with FIG. 2 by way of "steady area transition" in two transition zones $\ddot{U}_V$ and $\ddot{U}_H$ between the quadrants A, B, C and D. For the formation of the difference pattern in the azimuth direction, the two halves composed of the quadrants A and C are occupied antiphase in comparison to the halves composed of the two quadrants B and D. For the formation of the difference pattern in the elevation direction, by contrast, the antenna half composed of the two quadrants A and B is excited antiphase in comparison to the antenna half composed of the two quadrants C and D. For example, the two triangularly shaped regions 3 of the quadrant A extend across the symmetry line 1, in contrast whereto the likewise triangular regions 2 which lie to the left of the symmetry line 1 belong to the quadrant B. In comparison to the major portion of the quadrant A, therefore, the regions 2, even though they lie to the left of the line of symmetry 1, are operated antiphase relative to the individual radiators of the quadrant A and equiphase with the individual radiators of the quadrant B. The line 5 therefore forms a parting line between the two quadrants A and B. A parting line 6 extends between the quadrants A and C, a parting line 7 extends between the quadrants C and D, and a parting line 8 extends between the quadrants B and D. The peaks of the zig-zag parting lines 5 and 7 limit the vertical extending transition zone $\ddot{U}_V$ and the peaks of the likewise zig-zag parting lines 6 and 8 enclose the horizontally extending transition zone $\ddot{U}_H$. In accordance with the curve $\Delta_K$ of FIG. 1, the amplitude slowly decreases and crosses the zero value at the line of symmetry with a finite slope due to the wedge-shaped and, therefore, steadily increasing a real portion of the oppositely-disposed, antiphase halves of the antenna area, the wedge shape resulting from the triangular shape of the regions 2 and 3.

More specifically, the curve graduation of the curve $\Delta_k$ shown in FIG. 1 can be shaped and optimized by the geometrical shape lent to the antiphase individual radiator regions 2 and 3 which can deviate from a triangle. Such departures are illustrated in the circled area VAR of FIG. 2.

Figure 3:
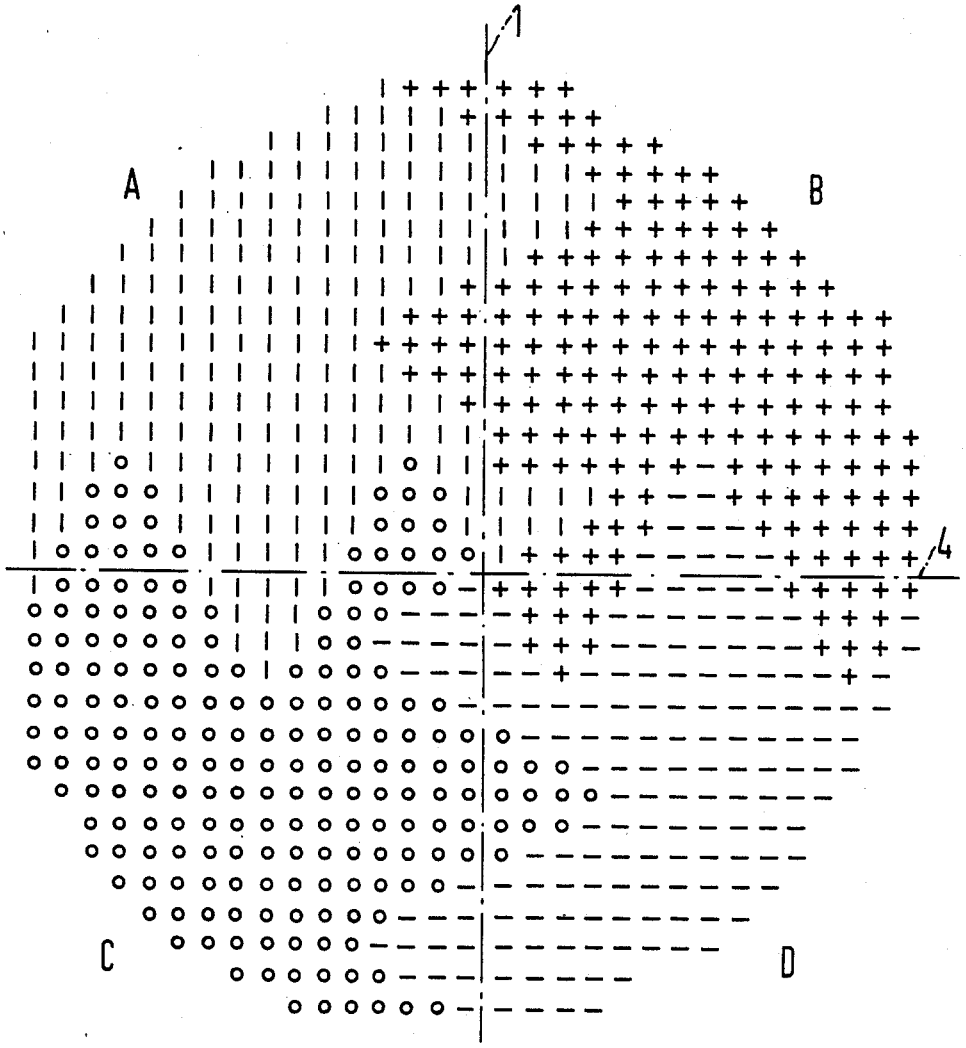
FIG. 3 is a graphic representation of the quadrant assignment of the individual radiators for the antenna arrangement of FIG. 2.

FIG. 3 illustrates how the discrete individual radiators of the phase-controlled antenna of FIG. 2 are allocated to the individual quadrants A, B, C and D. The entire antenna area of FIG. 2 is thereby not illustrated, but only a central region thereof. The individual radiators of the quadrant A are shown with small vertical strokes, the individual radiators of the quadrant B are shown by small crosses, the radiators of the quadrant C are shown by small rings and the individual radiators of the quadrant D are shown by small horizontal strokes. The individual radiators are arranged in vertical columns and horizontal rows. For the formation of the sum diagram, all individual radiators of all four quadrants A, B, C and D are excited equiphase or, respectively, with linear phase progressions given beam excursion, so that the boundaries between the quadrants A–D are ineffective. In the azimuth difference case, the individual radiators of the quadrants A and C are excited antiphase to the individual radiators of the quadrants B and D; in the elevation difference case, the individual radiators of the quadrants A and B are excited antiphase to the individual radiators of the quadrants C and D. The party line between the right and left halves of the antennas defined by the lines 5 and 7 of FIG. 2 or, respectively, the parting line between the upper and lower halves of the antenna defined by the parting lines 6 and 8 of FIG. 2, extends periodically so that the individual radiator proportion respectively belonging to the opposite half increases monotonously when the axis of symmetry 1 or, respectively, the axis of symmetry 4 is approached and crossed. This is clearly illustrated in FIG. 2.

Figure 4:
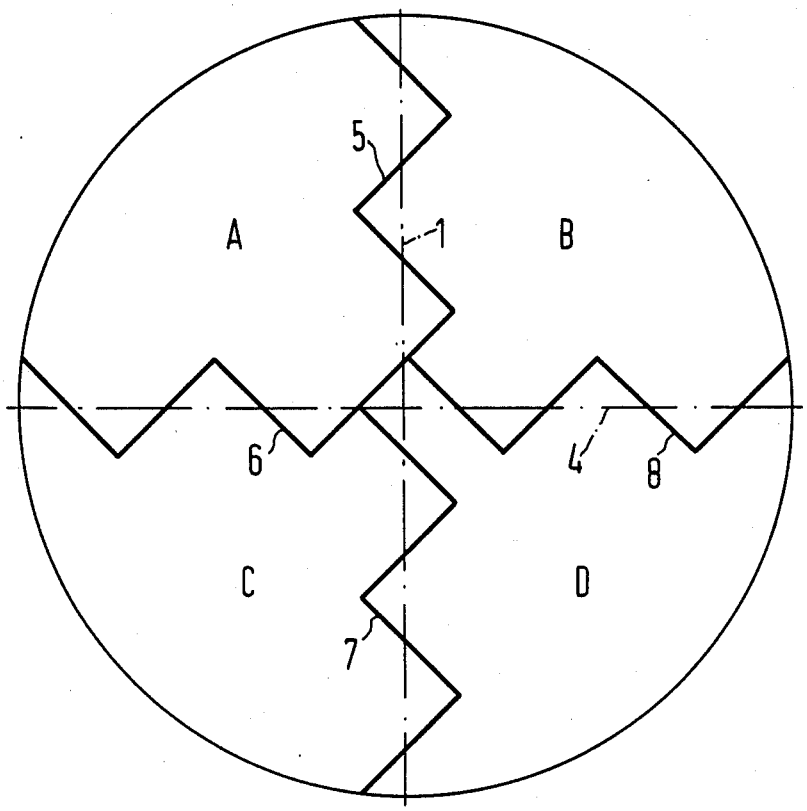
FIG. 4 is a schematic representation of a quadrant distribution on the basis of axial-symmetrical parting lines given a phase-controlled antenna constructed and operated in accordance with the present invention.

Potentially occurring, small orientation errors of the azimuth/elevation axis can be avoided by a special selection of the parting lines between the antenna halves. A division of the quadrants A, B, C and D by axial-symmetrical parting lines 5, 6, 7 and 8 is illustrated in FIG. 4.

Figure 5:
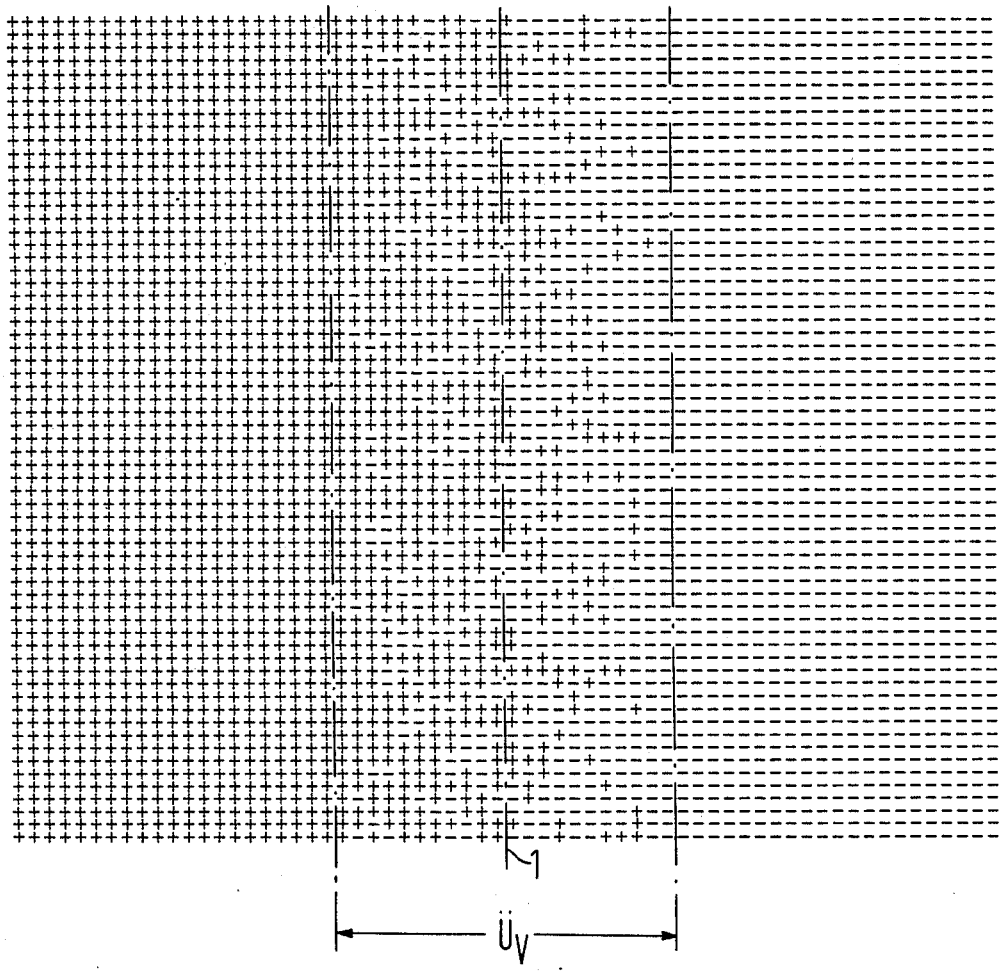
FIG. 5 is a schematic representation of a half assignment of the individual radiators in an antenna constructed and operated in accordance with the invention wherein the antiphase-excited individual radiators are stastically distributed in the transition zone.

FIG. 5 illustrates how the discrete individual radiators of a phase-controlled antenna with line feed occupied antiphase in two halves for generating the difference pattern are allocated to these two halves. The individual radiators of the left half are shown by small crosses (positive phase polarity) and those of the right half are shown by small horizontal strokes (negative phase polarity). The transition zone $\ddot{U}_V$ extends to the left and right of a vertical line of symmetry 1, extending equally to the left and to the right. The individual radiators are arranged in vertical columns and horizontal rows. For the formation of the sum pattern, all individual radiators of both halves are excited equiphase or, respectively, with a linear phase progression given beam excursion, so that the boundary, i.e. the transition zone $\ddot{U}_V$, between the two antenna halves becomes ineffective. In the difference case, the transition zone $\ddot{U}_V$ extending at the left and right along the line of symmetry 1 is fashioned such that, along its left edge, all individual radiators in a vertical strip have positive phase polarity and, along its right edge, all individual radiators in a vertical strip have negative phase polarity. When one migrates from the left edge into the center of the transition zone $\ddot{U}_V$, then the number of negatively phase-polarized individual radiators increases in the vertical strips (columns), in contrast whereto the number of positive phase-polarized individual radiators per strip (column) increases given a migration from the right edge into the center. Just as many positively as negatively phase-polarized individual radiators exist in a vertical strip immediately at the line of symmetry 1. The individual radiators respectively excited antiphase are statistically distributed in the individual strips (columns). A transition zone having statistical distribution of the antiphase individual radiators derives, whereby the density of the individual radiators respectively excited antiphase increases from the two edges up to the line of symmetry 1 in the center of the transition zone $\ddot{U}_V$. A nearly optimum difference excitation pattern occurs as a result of such a design of the transition zone $\ddot{U}_V$. Of course, this principle of statistical distribution can also be applied given an antenna having difference patterns in two planes. In this case four quadrants are provided, these being separated by transition zones along two, crossed lines of symmetry.

Figure 6:
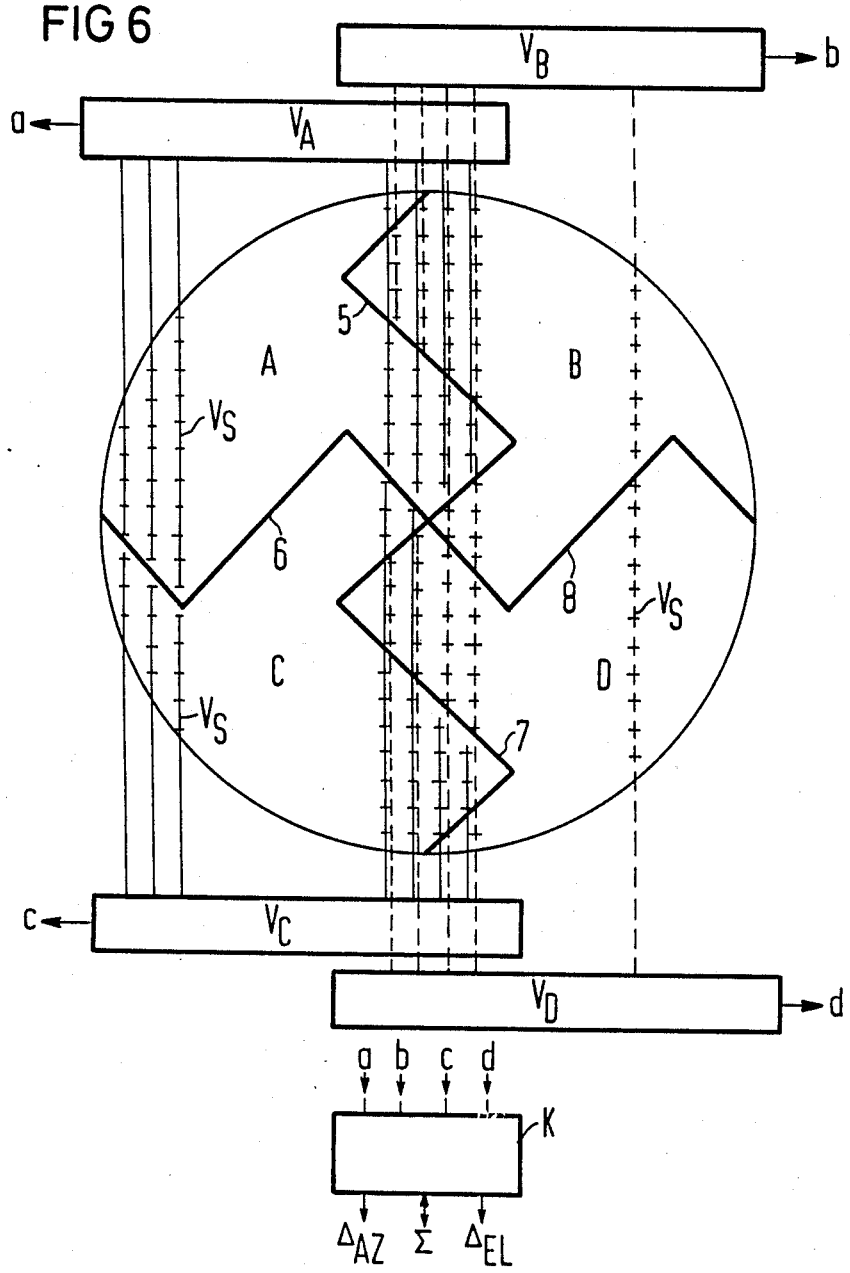
FIG. 6 is a schematic representation of an advantageous feed principle for a phase-controlled antenna comprising four quadrants and constructed and operated in accordance with the present invention.

FIG. 6 illustrates an exemplary embodiment of a feed principle for a phase-controlled monopulse antenna for low side lobe difference patterns in accordance with the present invention. The feed of the four split quadrants A, B, C and D thereby occurs by way of vertical distributor lines $V_S$ which respectively service the individual radiators in a column of one of the four quadrants A–D and are, in turn, combined at four horizontal distributors $V_A$, $V_B$, $V_C$ and $V_D$ assigned to the four quadrants A–D. In the vertically extending transition zone, the radiator elements lying in the columns belong to the right antenna half composed of the two quadrants B and D or to the left antenna half composed of the two quadrants A and C, depending upon whether they lie to the right or to the left of the zig-zag parting line 5, 7. The distributor lines $V_S$ extending to the various quadrants A, B, C and D therefore overlap in the region of the extent of the parting line 5, 7. In this region of extent, two vertical distributor lines $V_S$ per column then extend parallel to one another. In FIG. 6, these vertical distributor lines $V_S$ extending parallel to one another are indicated by solid or, respectively, broken lines extending next to one another which, however, are are coupled to the individual radiators belonging to their quadrants A, B, C or D. The radiator couplings are indicated by cross strokes at the vertical distributor lines $V_S$.

Given execution of the distributor lines $V_S$ in triplate or microstrip technology, the distributor lines $V_S$ belonging to one column can be arranged back-to-back relative to one another in a space-saving manner. Under given conditions, the two distributor lines in the vertically extending transition zone can also be disposed on a common carrier plate or the carrier plate is divided into portions pertaining to the right or, respectively, left half, these portions then being fed by the distributor for the quadrants A, B or, respectively, C, D. The outputs a, b, c and d of the horizontally extending distributors $V_A$, $V_B$, $V_C$ and $V_D$ are combined in the usual manner at the monopulse comparator K to form the sum channel $\Sigma$, azinauth difference channel $\Delta_{AZ}$ and elevation difference channel $\Delta_{EL}$. Advantageously, the horizontally extending distributors $V_A$–$V_D$ will be arranged more in the center of the quadrants A–D or in the center of the overall antenna in order to reduce the line lengths between the individual radiators and the comparator K.

The allocation of the distributor lines $V_S$ to the horizontal or vertical plane can be interchanged, so that the distributor lines no longer supply the columns, but the rows, and therefore extend horizontally.

An advantageous feature of the present invention is that a correction can also be undertaken in the outer annular regions of the difference excitation of FIG. 1. To this end, an antiphase excitation of individual radiators disposed thereat is also undertaken in regions of the halves or quadrants of the antenna area which lie at the greater distance from the line of symmetry or, respectively, from the lines of symmetry. In the antenna of, for example, FIG. 5 comprising two antenna halves fed antiphase, some of the individual radiators identified with the character (+) to the left of the transition zone 1 are then excited with the character (−) and not with the character (+). Accordingly, some of the individual radiators identified with the character (−) to the right of the transition zone are not so excited, but are excited in accordance with the character (+). The antiphase feed of the individual radiators in the quadrants A, B, C and D of the antenna of FIG. 3 is analogous. In quadrant A, for example, some of the outer individual radiators are then not fed with the phase identified by a vertical stroke but are fed with the antiphase identified by the character (+) and by a small circle.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A line-fed phase controlled antenna comprising:

a plurality of individual radiators disposed in a plane which is shaped symmetrically with respect to a line of symmetry for generating a sum pattern by equiphase driving the amplitude excitation of all radiators and a difference pattern by antiphase driving the amplitude excitation of the radiators on both sides of the line of symmetry;

a transition zone extending along the line of symmetry and having equal widths on each side of the line of symmetry between the radiators driven with antiphase amplitude excitations;

the radiators in the transition zone being disposed in lines parallel to one another and in the direction of the line of symmetry, the relative number of antiphase-excited radiators of each line of the transition zone, increasing from 0% at each edge of the transition zone to 50% at the line of symmetry.

2. The antenna of claim 1, wherein:

the individual antiphase excited radiators are distributed in each line of the transition zone in accordance with a statistical distribution.

3. The antenna of claim 1, wherein:

the transition zone comprises antiphase driven ones of said radiators located periodically and alternately in regions on both sides of the line of symmetry so that there succeeds periodically one area and another area along the line of symmetry whereby each area has, respectively, an antiphase area on the opposite side of the line of symmetry.

4. The antenna of claim 3, wherein:

the regions having the antiphase driven ones of said radiators are in the shape of equilateral triangles with the line of symmetry serving as a base for each such triangle.

5. A line-fed phase-controlled antenna comprising:

a plurality of individual radiators disposed in columns and rows in a common plane and generating a sum pattern by equiphase driving the amplitude excitation of all radiators, a first difference azimuth pattern and a second difference elevation pattern;

first and second lines of symmetry dividing the common plane at the first, second, third and fourth quadrants;

first and second transition zones each extending along and for predetermined equal widths on the sides of a respective line of symmetry;

certain ones of said radiators lying along a line of symmetry belonging to the quadrant on the other side of that line of symmetry; and driving means for exciting said radiators such that, for the formation of the azimuth difference pattern, those radiators lying in said first and second quadrants on one side of said first line of symmetry are excited antiphase with respect to those radiators on the opposite side of said first line of symmetry in said third and fourth quadrants, for the formation of the elevation difference pattern, those radiators lying in the first and third quadrants on one side of the second line of symmetry are excited antiphase with respect to those radiators in the second and fourth quadrants on the opposite side of the sewcond line of symmetry.

6. The antenna of claim 5, wherein:

the driving means comprises a plurality of distributor lines for each quadrant, each of said distributor lines connected to the radiators of the respective column of a quadrant, and four distributors connected to said distributor lines, said connections being in pairs in the first transition zone on each side of said first line of symmetry.

7. A line-fed phase-controlled antenna comprising:

a plurality of individual radiators disposed in column and rows in a common plane and generating a sum pattern, a first difference azimuth pattern and a second difference elevation pattern;

first and second lines of symmetry dividing the common plane into first, second, third and fourth quadrants;

first ans second transition zones each extending along and for predetermined widths on the sides of the respective line of symmetry;

certain ones of said radiators lying along a line of symmetry belonging to the quadrant on the other side of that line of symmetry; and driving means for exciting said radiators such that, for the formation of the azimuth difference pattern, those radiators lying in said first and second quadrants on one side of said first line of symmetry are excited antiphase with respect to those radiators on the opposite side of said first line of symmetry in said third and fourth quadrants, for the formation of the elevation difference pattern, those radiators lying in the first and third quadrants on one side of the second line of symmetry are excited antiphase with respect to those radiators in the second and fourth quadrants on the opposite side of said second line of symmetry, and, for forming a sum pattern all radiators are excited by equiphase amplitude driving.

* * * * *